United States Patent [19]

Kreeger

[11] Patent Number: 4,635,562

[45] Date of Patent: Jan. 13, 1987

[54] SIDEWALL ASSEMBLY FOR TOTE BOX

[75] Inventor: Elsmer W. Kreeger, Howell, Mich.

[73] Assignee: Pinckney Molded Plastics, Inc., Howell, Mich.

[21] Appl. No.: 666,119

[22] Filed: Oct. 29, 1984

[51] Int. Cl.[4] ..... B65D 19/44

[52] U.S. Cl. ..... 108/55.1; 108/56.1

[58] Field of Search ..... 108/55.1, 56.1, 902, 108/901; 206/386, 600

[56] References Cited

U.S. PATENT DOCUMENTS

| | | | |
|---|---|---|---|
| 3,824,933 | 7/1974 | Lind | 108/56.1 |
| 3,989,156 | 11/1976 | Lowry | 206/600 X |
| 4,316,419 | 2/1982 | Cupido | 108/92 X |

FOREIGN PATENT DOCUMENTS

| | | | |
|---|---|---|---|
| 0071467 | 2/1983 | European Pat. Off. | 206/600 |
| 0070162 | 6/1927 | Sweden | 220/4 F |
| 2039850 | 8/1980 | United Kingdom | 220/4 F |

*Primary Examiner*—William E. Lyddane
*Assistant Examiner*—José V. Chen
*Attorney, Agent, or Firm*—Basile, Weintraub & Hanlon

[57] ABSTRACT

A tote box assembly or the like is made up of molded plastic components wherein complementary interlocking members at each end of each sidewall rigidly interlock the sidewalls in assembled relationship with each other. Coupling legs integrally formed along the bottom edge of each sidewall are detachably snap locked into openings formed along each side of the pallet platform.

3 Claims, 10 Drawing Figures

SIDEWALL ASSEMBLY FOR TOTE BOX

BACKGROUND OF THE INVENTION

The present invention is directed to tote boxes or containers typically employed in manufacturing plants as receptacles for storing or transporting parts in bulk. Conventionally, these tote boxes usually take the form of a wooden pallet having upstanding sidewalls to constitute a simple, open-topped box which can be readily transported by a forklift truck.

In recent years, it has been found practical to construct pallets from molded plastic material, such as polypropylene or similar materials. Plastic pallets of this type may be readily formed by a molding operation, a much more efficient production method than the cutting and nailing together of the various parts of a conventional wooden pallet. Plastic pallets of this type typically take the form of either a one-piece pallet in which the load supporting platform is formed with downwardly projecting feet (to provide access for forklift tines beneath the platform) or in some cases made from identical upper and lower halves having mating male and female projections on the inner side of the platform which may be joined or interlocked to support the two platforms in spaced relationship to each other, again to provide for access of forklift tines beneath the uppermost platform.

The present invention is especially concerned with a sidewall assembly constructed from molded plastic sidewall elements which, for use upon a square pallet, are of identical construction and which may be firmly and rigidly locked in assembled relationship with each other without requiring the use of any separate fastening elements or bonding steps.

SUMMARY OF THE INVENTION

In accordance with the present invention, a tote box is constructed with its bottom defined by a pallet of molded plastic material with the load supporting platform of the pallet formed with a series of rectangular openings extending along each side edge of the pallet.

Sidewalls are formed of a molded plastic material, each sidewall, in the case where the pallet is square, being of identical construction and having downwardly projecting cantilevered legs at spaced locations along the bottom edge of the pallet located to project through the platform openings. The legs are provided with outwardly projecting latch teeth which, when the sidewall is seated upon the pallet, are engaged beneath the underside of the load supporting platform to lock the sidewall against vertical withdrawal from the platform. Along each vertical end edge of the sidewall, complementary interlocking members and grooves extend vertically and are configured in a manner such that the interlocking member at one end of one sidewall may be vertically inserted into the interlocking slot at the adjacent end of the adjacent sidewall to interlock the two sidewalls to each other at the corner juncture.

Other objects and features of the invention will become apparent by reference to the following specification and to the drawings.

IN THE DRAWINGS

DESCRIPTION OF THE PREFERRED EMBODIMENT

Figure 1:
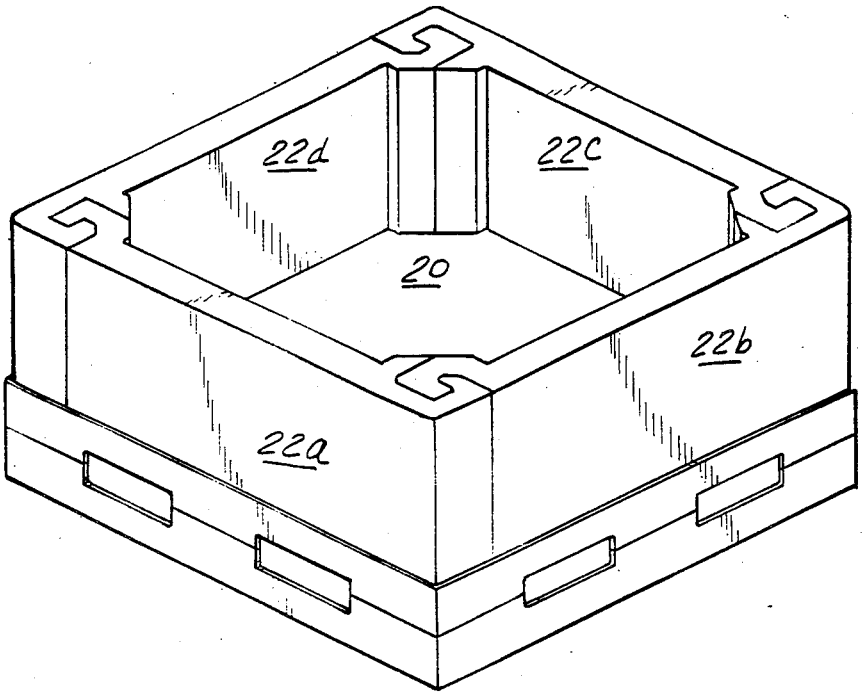
FIG. 1 is a perspective view a tote box embodying the present invention.

Referring first to FIG. 1, there is shown in that figure a tote box embodying the present invention whose bottom is defined by a pallet 20, which in the embodiment disclosed is of square configuration, and four identical upwardly projecting sidewalls *22a, 22b, 22c* and *22d*. Pallet 20 and sidewalls *22a, 22b, 22c* and *22d* are formed from a molded plastic material, such as polypropylene.

Figure 4:
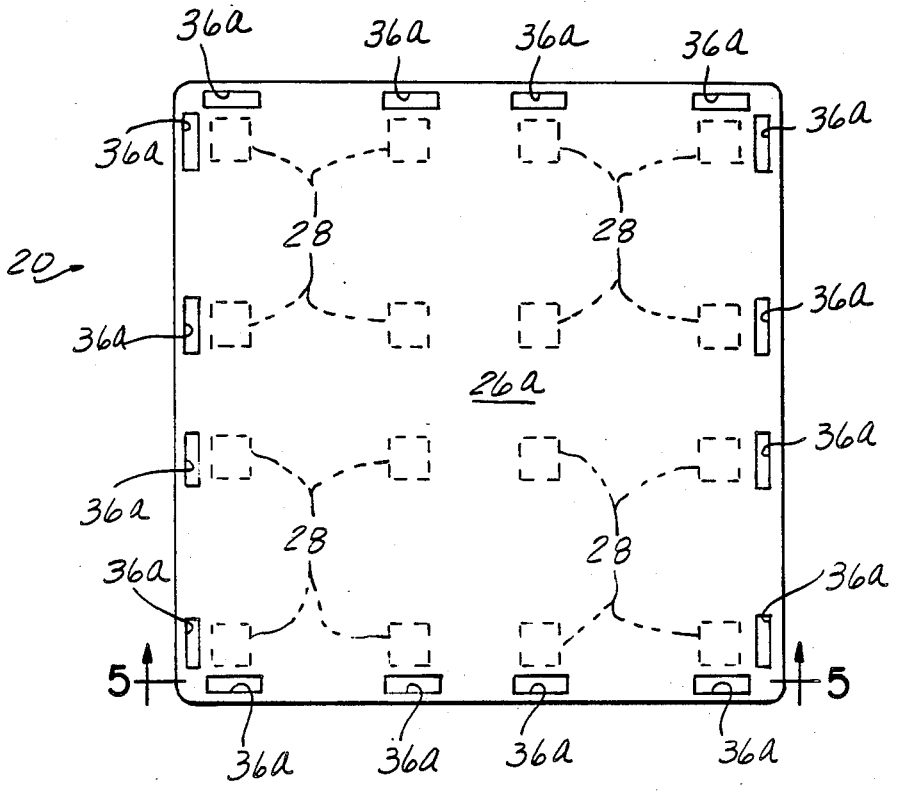
FIG. 4 is a top plan view of a pallet constituting the bottom of the box of FIG. 1.
Figure 5:
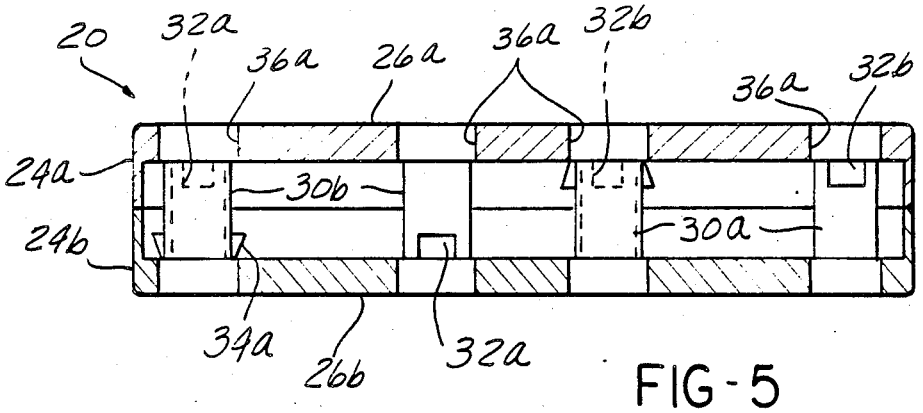
FIG. 5 is a cross-sectional view of the pallet taken on line 5—5 of FIG. 4.

One exemplary form of pallet is shown in FIGS. 4 and 5. This particular form of pallet is made up of identical upper and lower halves *24a, 24b*. Each of the pallet halves *24a, 24b* includes a rigid main panel or platform *26a* having vertically projecting mating coupling post assemblies 28 projecting from the inner surface of the platform at the locations indicated in FIG. 4. For panel *24a*, the coupling post assemblies 28 include a pair of parallel rows of hollow, vertical posts *30a* integral at their upper ends with panel *26a* at each of the two rows of locations 28 at the right-hand side of FIG. 4. At the eight locations of the left-hand side of FIG. 4, the upper panel *26a* includes a pair of legs *32a* which are spaced and oriented to be received within opposed hollow posts *30b* integral with and projecting upwardly from the platform *26b* of the lower pallet half. The legs *32a* are provided at their distal ends with outwardly projecting teeth, such as *34a*, which project through openings formed in the sidewall of the opposed post 30. A series of like, rectangular openings *36a* extend along each side of platfrom *26a*.

Insofar as the present invention is concerned, the precise construction of pallet 20 may take any of several forms. The basic features as required by the present invention include the presence of a platform, such as *26a*, supported at an elevation such that forklift tines may be inserted beneath the platform and a plurality of rectangular openings, such as *36a*, extending along each side edge of the platform and entirely through the platform for insertion of the forklift tines.

In those cases where the pallet 20 is of square configuration, all of the individual sidewalls *22a, 22b, 22c* and *22d* are of identical construction and may be producted in a single mold. For simplicity, as shown in the drawings, the sidewalls *22a, 22b, 22c* and *22d* are shown as having a flat outer side surface with the wall of uniform thickness. In practice, as is well appreciated by those skilled in the art, the outer surface of the sidewalls would normally be formed with recesses and ribs to reduce the weight and volume of material required while maintaining adequate structural rigidity.

Figure 2:
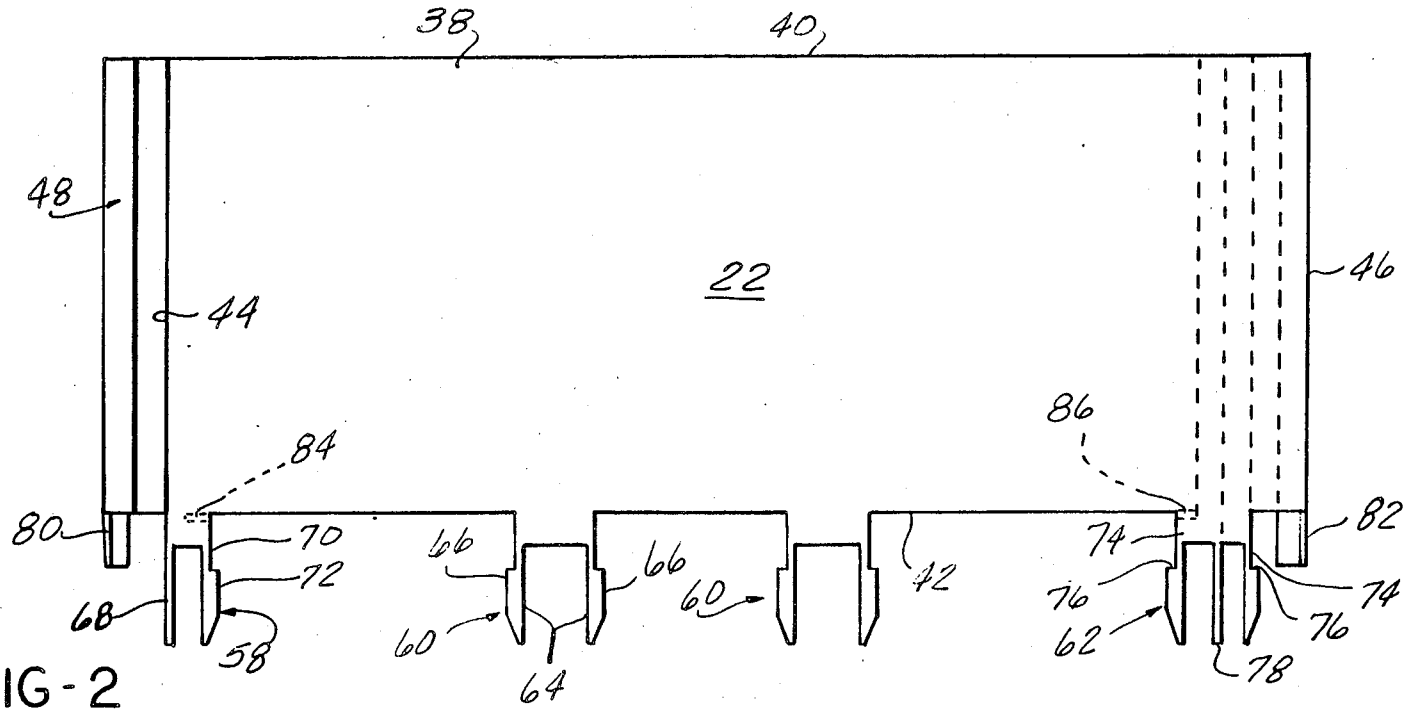
FIG. 2 is a side view of the outer side of a sidewall employed in the box of FIG. 1.
Figure 3:
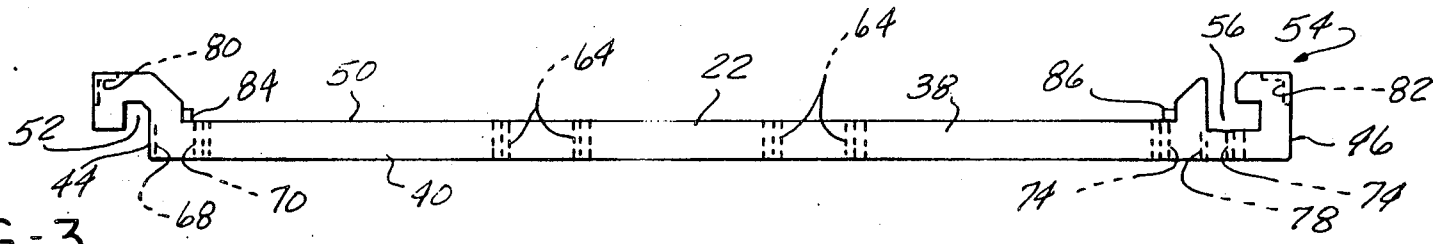
FIG. 3 is a top plan view of the sidewall of FIG. 2.

In FIGS. 2 and 3, an outer side and top plan view of a sidewall 22 are shown.

Referring now to FIGS. 2 and 3, sidewall 22 includes a main panel having parallel upper and lower edges 42 and vertical end edges 44, 46.

Figure 1A:
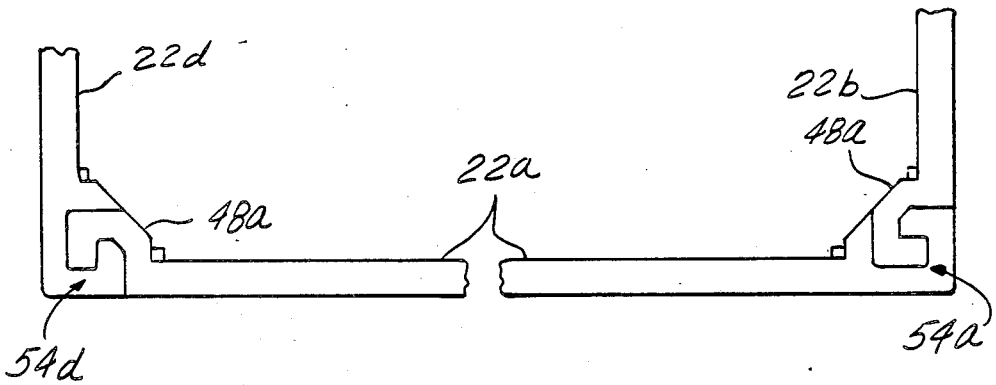
FIG. 1A is a fragmentary top plan view of FIG. 1.
Figure 6:
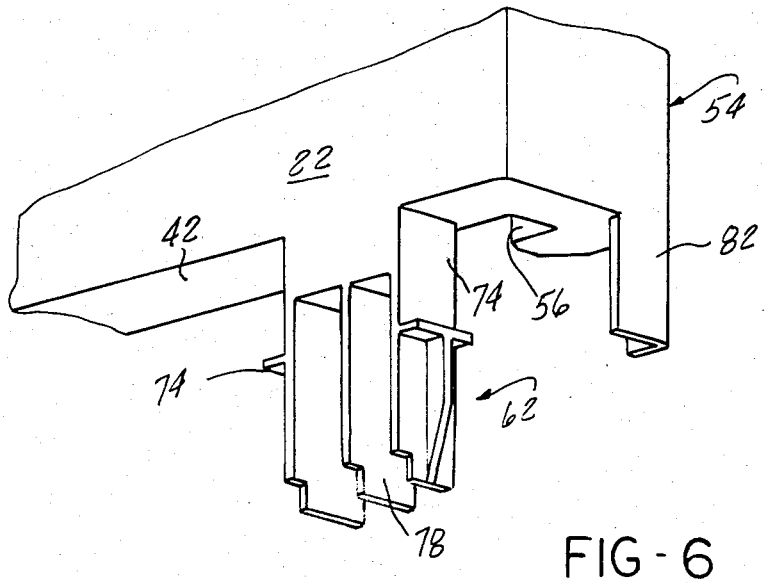
FIG. 6 is a partial, detailed, perspective view looking upwardly and inwardly at one end of the sidewall of FIG. 2.
Figure 7:
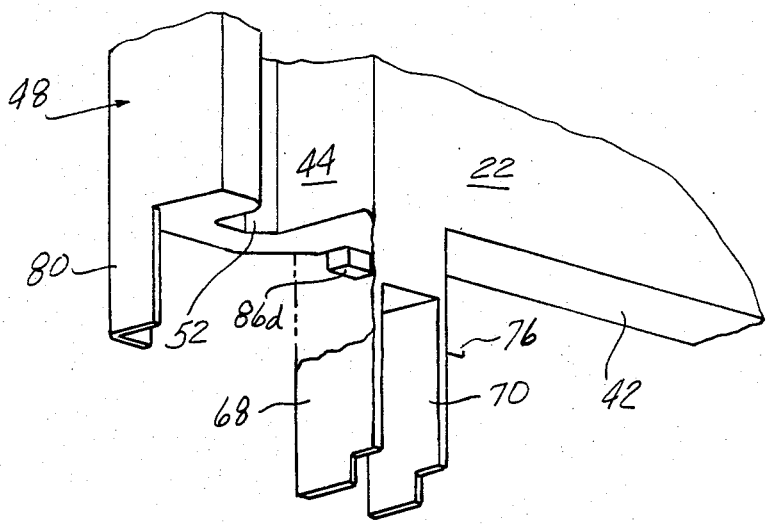
FIG. 7 is a partial, detailed, perspective view looking upwardly and inwardly at the opposite end of the sidewall of FIG. 2.

At end edge 46 of sidewall 22, as can be best seen in FIGS. 3 and 6 a first interlocking member designated generally 54 is formed to project inwardly from the inner side 50 of sidewall 22 and also inwardly from the end edge 46. The interlocking member 54 is formed with a vertical slot 56 of generally L-shaped configuration when viewed, in horizontal cross section, the interlocking member 54 of sidewall 22 has side surfaces which lie in vertical general planes, and the member 54 extends from upper edge 40 of the sidewall to its lower edge 42. At edge 44, as best seen in FIGS. 2, 3 and 7, a second interlocking member designated generally as 48 extends rearwardly from the inner surface 50 of the sidewall and outwardly beyond edge 44 and is formed with a vertical slot 52 opening toward the outer edge of sidewall 22. The various side surfaces of interlocking member 48 lie in general vertical planes, and member 48 extends from upper edge 40 of wall 22 to its lower edge 42. The interlocking member 48 is complementary to, but oriented 90° from the horizontal cross section of the interlocking member 54. As best seen in FIGS. 1 and 1*a*, the interlocking members 48, 54 of adjacent sidewalls can be interlocked with each other by vertically sliding and interlocking members, such as 48*a* of one sidewall 22*a*, into the interlocking member 54*d* of an adjacent sidewall 22*d*. When so interlocked, the two adjacent sidewalls are rigidly coupled to each other against relative movement in any other direction than the vertical.

To mount the individual sidewalls 22 on pallet 20, a plurality of coupling leg assemblies including a leg assembly designated generally 58 adjacent end edge 44, a pair of like centrally located coupling leg assemblies 60 and a coupling leg assembly designated generally 62 adjacent edge 46 are formed integrally with and project downwardly from the lower edge 42 of sidewall 22.

The two centrally located coupling leg assemblies 60 are identical and each include a pair of spaced legs 64 having outwardly projecting, generally wedge-shaped (as viewed in FIG. 2) latch teeth 66. The coupling assemblies 60 are spaced from each other and so located as to be received within the two central openings 36*a* on one side of the pallet platform 26*a* by pushing the coupling assemblies down into the respective openings 36*a*. The wedge-shaped surface of the latch teeth causes the legs 64 to flex inwardly toward each other as the coupling leg assembly moves downwardly through opening 36 until the teeth 66 pass below the underside of platform 26*a*, at which time the legs snap outwardly to engage the teeth beneath the undersurface of the platform at opposite ends of the openings 36*a*.

Coupling leg assembly 58 includes a smooth sided leg 68 and a second leg 70 which includes a latch tooth 72 of the same general configuration as teeth 66 on coupling members 60.

Coupling leg assembly 62 includes a pair of outer legs 74, formed with outwardly projecting latch teeth 76 similar in configuration to latch teeth 66, and a central leg 78 which is smooth sided. As indicated in FIG. 3, the left-hand leg 74 of coupling assembly 62 extends the full width or thickness of sidewall 22, while the central leg 78 extends from the outer side of sidewall 22 only to the slot 56 of the interlocking member 54, as does the right-hand leg 74.

Downwardly projecting stabilizing posts 80 and 82 are located respectively on interlocking members 48 and 54 and are of generally right-angled, horizontal cross section.

A pair of square locator pads 84, 86 are integrally formed on each sidewall at the juncture of the interlocking members 48, 54 respectively (see particularly FIGS. 2, 3, 8 and 9).

Figure 8:
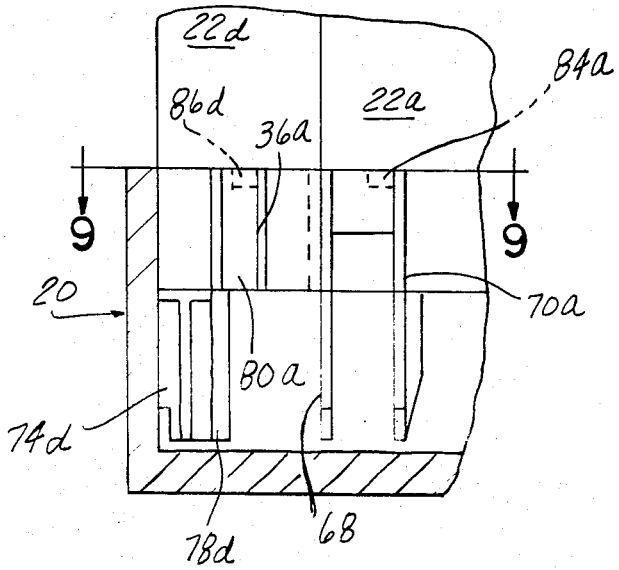
FIG. 8 is a partial, detailed, side view of the lower portion of a corner of the box of FIG. 1.
Figure 9:
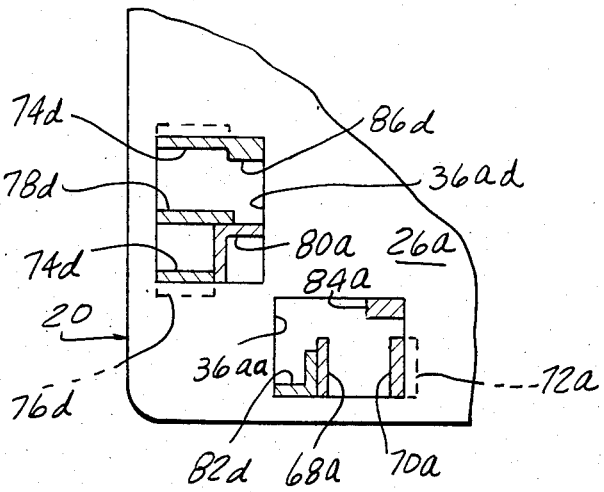
FIG. 9 is a detailed, cross-sectional view taken on the line 9—9 of FIG. 8.

FIGS. 8 and 9 are detailed views, partially in section, of the pallet at that corner at which sides 22*a* and 22*d* (FIG. 1) intersect. FIG. 9 is a cross section taken on the plane of the top surface of pallet platform 26*a* which thus shows in section those portions of adjacent sidewalls 22*a* and 22*d* which project downwardly through the two openings 36*a* at this particular corner of the pallet platform. To distinguish these two openings, the openings have been identified in FIG. 9 as 36*ad* and 36*aa*, respectively indicating the endmost openings 36*a* on those sides on which sidewalls 22*d* and 22*a* are assembled.

It will be noted that opening 36*ad* receives not only the legs 74*d*, 78*d* and locating button 86*d* of wall 22*d*, but also receives the stabilizing member 80*a* of sidewall 22*a* which is engaged between the walls of opening 36*ad* and the inner sides of central leg 78*d* and the endmost leg 74*d* of wall 22*d*. The stabilizing projection 82*d* of wall 22*d* projects, as shown in FIG. 9, into opening 36*aa* and bears against the smooth sided end leg 68*a* of wall 22*a*. Leg 70*a* and locator button 84*a* are likewise received, as indicated in the opening 36*aa*.

While one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

I claim:

1. A tote box assembly or the like comprising a pallet including a horizontal rectangular main panel, said main panel having a plurality of rectangular openings therethrough disposed along and adjacent to each side edge thereof, a sidewall extending along each side edge of the main panel and projecting upwardly therefrom, each of said sidewalls having: (a) a plurality of latching leg means projecting downwardly from the lower edge through said openings in said main panel, the leg means having latch teeth engagable with the underside of said main panel to positively prevent vertical withdrawal of the sidewall from said main panel; (b) a first interlocking member at one end of the sidewall defining a vertical slot of generally L-shaped, horizontal cross section extending from the top to the bottom of said sidewall, said first interlocking member including first, second and third webs, said first and said second webs projecting perpendicularly from the inner side of the sidewall in spaced parallel relationship, said first web extending along said one end of said sidewall, and said third web extending perpendicularly from said first web in spaced opposed parallel relationship to said sidewall toward said second web and terminating at a vertical edge spaced from said second web, one of the latching leg means located on the sidewall immediately adjacent to said first interlocking member and projecting downward therefrom, said first interlocking member also having a stabilizing post projecting downward therefrom such that the associated latching leg means are received within a rectangular opening on a first side edge of said main panel immediately below the sidewall and the stabilizing post is received within a rectangular opening on a second side edge of said main panel, perpendicularly adjacent to said first side edge; and (c) a second interlocking member at the respective other end of the sidewall, the second interlocking member having a generally L-shaped horizontal cross section complementary to that of said slot of said first interlocking member and oriented such that the second interlocking member of a first sidewall extending along a first side edge of said main panel is interlockingly received within the slot of a first interlocking member of a second sidewall extending along a second adjacent side edge of said main panel to lock said first and second sidewalls into a fixed perpendicular relationship to each other and against horizontal movement relative to each other, the second interlocking member having latching leg means located on the sidewall immediately adjacent thereto projecting downwardly therefrom, and a stabilizing post projecting downwardly from the second interlocking member such that the latching leg means are received within a rectangular opening on the first side edge of the main panel immediately below the sidewall and the stabilizing post is received within a rectangular opening on a third side edge perpendicularly adjacent to the first side edge and parallel to the second side edge, the stabilizing post of a second interlocking member of a second side wall and the latching leg means of a first interlocking member of a first side wall adapted to project into the same rectangular opening located on the first side edge while the stabilizing post of a first interlocking member of a first sidewall and the latching leg means of a second interlocking member of a second side wall project into a rectangular opening located on a side edge perpendicular to the first side edge.

2. The invention defined in claim 1 wherein a first of said openings is located adjacent said first side edge adjacent its juncture with said second side edge and a second of said openings is located adjacent said second side edge adjacent its juncture with said first side edge, each of said sidewalls further comprising stabilizing members projecting vertically downwardly therefrom respectively from said first web means and said interlocking member, said first sidewall having latching leg means received in said first opening and a stabilizing member received in said second opening and said second sidewall having latching leg means received in said second opening and a stabilizing member received in said first opening.

3. The invention defined in claim 2 wherein each stabilizing member is engaged by and between a wall of the opening in which it is received and a portion of the latching leg means is received in that opening.

* * * * *

UNITED STATES PATENT OFFICE

CERTIFICATE OF CORRECTION

Patent No. 4,635,562 Dated January 13, 1987

Inventor(s) Elsmer W. Kreeger

It is certified that error appears in the above-identified patent and that said Letters Patent are hereby corrected as shown below:

Column 1, line 66, after "view" insert --of--.

Column 3, line 4, after "lower edges" insert --40,--.

Column 3, line 12, after "cross section" delete "," and insert --.--.

Column 3, line 12, delete "the" and insert --The--.

Signed and Sealed this

Twenty-seventh Day of October, 1987

*Attest:*

DONALD J. QUIGG

*Attesting Officer*

*Commissioner of Patents and Trademarks*